US005794590A

United States Patent [19]

Bergmann

[11] Patent Number: 5,794,590

[45] Date of Patent: Aug. 18, 1998

[54] ENGINE BRAKE FOR A MULTICYLINDER DIESEL ENGINE

[75] Inventor: Horst Bergmann, Esslingen, Germany

[73] Assignee: Mercedes-Benz AG, Stuttgart, Germany

[21] Appl. No.: 835,382

[22] Filed: Apr. 7, 1997

[30] Foreign Application Priority Data

Apr. 20, 1996 [DE] Germany ..... 196 15 739.0

[51] Int. Cl.[6] ..... F01L 13/06

[52] U.S. Cl. ..... 123/321; 123/324

[58] Field of Search ..... 123/321, 322, 123/324

[56] References Cited

U.S. PATENT DOCUMENTS 4,510,900 4/1985 Quenneville ..... 123/321
4,741,307 5/1988 Meneely ..... 123/321

FOREIGN PATENT DOCUMENTS 0 608 520 8/1994 European Pat. Off. .
0 608 521 8/1994 European Pat. Off. .

*Primary Examiner*—Andrew M. Dolinar
*Attorney, Agent, or Firm*—Klaus T. Bach

[57] ABSTRACT

In an engine brake for a multicylinder Diesel engine having a cylinder head with at least one exhaust or decompression valve for each cylinder for controlling the discharge of gases from the cylinder, a high pressure fuel injection system with a common fuel supply line for distributing fuel under pressure to the various cylinders and with at least one camshaft-operated plug-in fuel pump for supplying fuel under pressure to the common fuel supply line, an engine brake actuating system is provided which includes, for every two cylinders operating at a 360° crankshaft phase difference, a plug-in pump which concurrently operates the exhaust or decompression valves of the associated two cylinders, one at the end of its compression stroke and the other at the end of its exhaust stroke.

4 Claims, 2 Drawing Sheets

ENGINE BRAKE FOR A MULTICYLINDER DIESEL ENGINE

BACKGROUND OF THE INVENTION

The invention relates to an engine brake for a multicylinder Diesel engine having a cylinder head with decompression valves which are opened at the end of a compression stroke during engine braking operation.

Customary engine brake systems for internal combustion engines for utility vehicles comprise an engine brake valve, arranged in the engine exhaust duct and also a decompression valve which is continuously held open during the engine braking phase by pneumatic control means, in order to further increase engine braking power.

A further improvement in engine braking power is shown in EP 0 608 521 A1 in which a decompression brake contains a hydraulic activation device for controlling an exhaust valve of an internal combustion engine. The activation device, and thus of the exhaust valve, are operated by the engine's own fuel injection pump which contains a switch-over element disposed in the fuel injection line leading to the injection nozzle whereby pressurized fuel is directed either to the fuel injection nozzle or to the hydraulic activation device. The injection nozzle and activation device are assigned to different cylinders.

It is the object of the present invention to provide, in a multicylinder Diesel engine having an engine brake system and a fuel injection system as a well as a certain number of high pressure pumps, a simplified arrangement of the fuel injection system and the engine brake system with low overall space requirements. Furthermore, the engine brake system should also be suitable for fuel injection systems using a high-pressure fuel accumulator as a common supply line (common rail) for solenoid valve-controlled injection nozzles.

SUMMARY OF THE INVENTION

In an engine brake for a multicylinder Diesel engine having a cylinder head with at least one exhaust or decompression valve for each cylinder for controlling the discharge of gases from the cylinder, a high pressure fuel injection system with a common fuel supply line for distributing fuel under pressure to the various cylinders and with at least one camshaft-operated plug-in fuel pump for supplying fuel under pressure to the common fuel supply line, an engine brake actuating system is provided which includes, for every two cylinders operating at a 360° crankshaft phase difference, a plug-in pump which concurrently operates the exhaust or decompression valves of the associated two cylinders, one at the end of its compression stroke and the other at the end of its exhaust stroke.

The measures according to the invention result in a clear separation between the fuel injection system and the engine brake system.

Switch-over elements, which are subject to failure are not used as path controller in the control line provided commonly for two activation devices. The high-pressure pump which is driven by a double cam cconcurrently activates the associated activation devices and thus the decompression or exhaust valves that is the engine brake valves, whereby the engine brake valves which are connected to the common control line are alternately activated at the end of the compression stroke and at the end of the exhaust stroke. The activation of the decompression valve at the end of the exhaust stroke has virtually no effect on the engine braking power or on the engine operation since the respective outlet valve is anyhow open at that point.

Overall, in particular the changing over from the known plug-in pump technology, that is from the use of an individual pump for each cylinder, to a common rail technology which requires at least one plug-in pump for a four cylinder engine or two plug-in pumps for a six cylinder or more than six cylinder engine, can be accomplished without structural changes to the cylinder casing. The abandoned pump reception openings are now used for plug-in pumps which supply high-pressure hydraulic fluid for operating the engine brake valves rather than for their originally intended purpose.

The clear separation of the injection system and engine brake system permits the use of engine oil for operating the brake valves as it is customary in conventional engine brake systems.

The invention is illustrated below and explained in greater detail with reference to the drawings.

DESCRIPTION OF PREFERRED EMBODIMENTS

Figure 1:
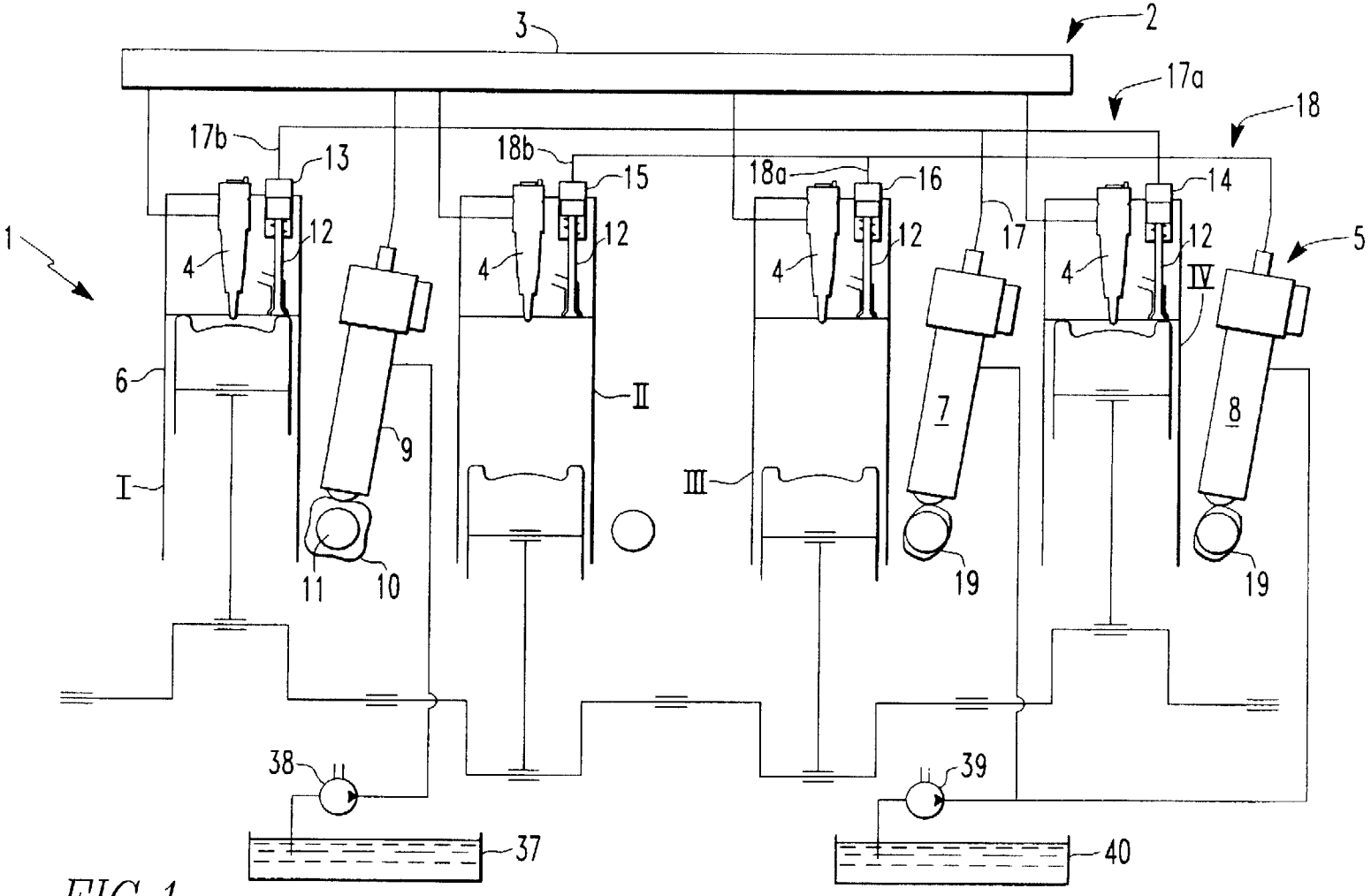
FIG. 1 shows the engine brake system according to the invention on a four-cylinder internal combustion engine.

A four cylinder Diesel internal combustion engine 1 for utility vehicles in accordance with FIG. 1 has a fuel injection system 2 with a common rail system including a common fuel supply line 3, acting as high pressure fuel accumulator, for all the solenoid valve-controlled injection nozzles 4 of an engine brake system 5 which is completely separated from the common rail fuel supply system.

The cylinder casing 6 of the four cylinder Diesel engine 1 is provided with four receptacle openings (not illustrated in detail) for high-pressure pumps in the form of plug-in pumps, of which the plug-in pumps 7 and 8 are functional parts in the engine brake system, while the plug-in pump 9 is responsible for the high-pressure supply of fuel to the common fuel supply line 3.

The plug-in pump 9 is driven by a camshaft 11 with four cams 10, however instead, it is also possible to use two plug-in pumps whose respective drive utilizes two cams per pump or, in six cylinder internal combustion engines, a cam structure with three cams for each pump (not illustrated).

The engine brake system for a four cylinder internal combustion engine comprises, in addition to the two plug-in pumps 7 and 8 for the decompression valves 12, four operating devices 13, 14, 15, 16 and control lines 17, 18 which are arranged in pairs. The common control line 17 connects, with its line sections **17*a* and 17*b*, the first double cam-driven plug-in pump 7 to the two operating devices 13, 14, and the common control line 18 connects, with its line sections 18*a* and 18*b*, the second double cam-driven plug-in pump 8 to the operating devices 15, 16**.

The two cylinders with the operating devices 13 and 14 and, respectively, 15 and 16 are displaced operationally by a crank shaft angle of 360° such that the operating device for one of the two cylinders is activated at the end of a compression stroke while the operating device for the other of the two cylinders is activated at the end of an exhaust stroke. Braking operation is thus achieved for the two cylinders by a single plug-in pump which is activated by the double cam 19 with a 180° cam angle interval. In this arrangement, both decompression valves 13 and 14 or 15 and 16 which are connected to a common control line are concurrently activated, one at the end of the compression stroke and the other at the end of the exhaust stroke.

The four cylinder internal combustion engine with the designated cylinders I, II, III, IV and the ignition sequence I, III, IV, II has the following line connection in the engine brake system:

One plug-in pump 7 is connected by the common control line 17 to the operating devices 13, 14 of the cylinders I and IV and the other plug-in pump 8 is connected by the common control line 18 to the operating devices 15, 16 of the cylinders II and III. The illustrated decompression valves 12 can at the same time be exhaust valves or decompression valves which are spatially separated from the exhaust valves.

In order to apply pressure to the operating device comprising a hydraulic piston and hydraulic cylinder, it is not necessary to use the high pressure fuel in the rail 3 with a pressure of for example over 1000 bar, but rather a fluid with a much lower pressure, for example, the relatively low pressure engine oil. In this way, the problems of internal leakage of the operating devices are avoided.

In a six-cylinder Diesel engine (illustrated in FIG. 2) having cylinders designated by I, II, III, IV, V, VI and the ignition sequence I, V, III, VI, II, IV, the line connections in the engine brake system are as follows:

The first plug-in pump 21 is connected, by the common control line 22 with its line sections 22*a* and 22*b*, to the operating devices 23, 24 of the cylinders I and VI; the second plug-in pump 25 is connected by the common control line 26 with its line sections 26*a* and 26*b*, to the operating devices 27, 28 of the cylinders II and V and the third plug-in pump 29 is connected by the common control line 30 with its line sections 30*a* and 30*b*, to the operating devices 31, 32 of the cylinders III and IV. Each of these plug-in pumps is driven by a double cam 33. Two plug-in pumps 35, 36 which are each driven by a three cam structure are used for supplying high pressure fuel to the common fuel supply line 34 (common rail).

Here also, the brake power control for every two cylinders whose ignition is offset by a 360° crank angle (CA) is achieved by means of a plug-in pump which is activated by a three-cam cam structure with a 120° cam angle interval.

Control lines arranged in pairs or common control lines are used as the line connections between a plug-in pump and two operating devices. The arrangement can equally well be realized in an internal combustion engine with eight or more cylinders.

In the case of the eight cylinder internal combustion engine, two plug-in pumps are still sufficient for supplying high pressure fuel to the common fuel supply line. The drive used for these two plug in pumps would in each case use a four-cam cam structures (not illustrated).

In FIG. 1, a fuel container is designated by 37 and a feed pump, which feeds fuel to the plug-in pump 9 of the four cylinder internal combustion engine, is designated by the numeral 38. As further shown an oil pump 39 takes oil from an oil container 40 and feeds it to the plug-in pumps 7 and 8 for use as the operating fluid for operating the engine brake system.

Figure 2:
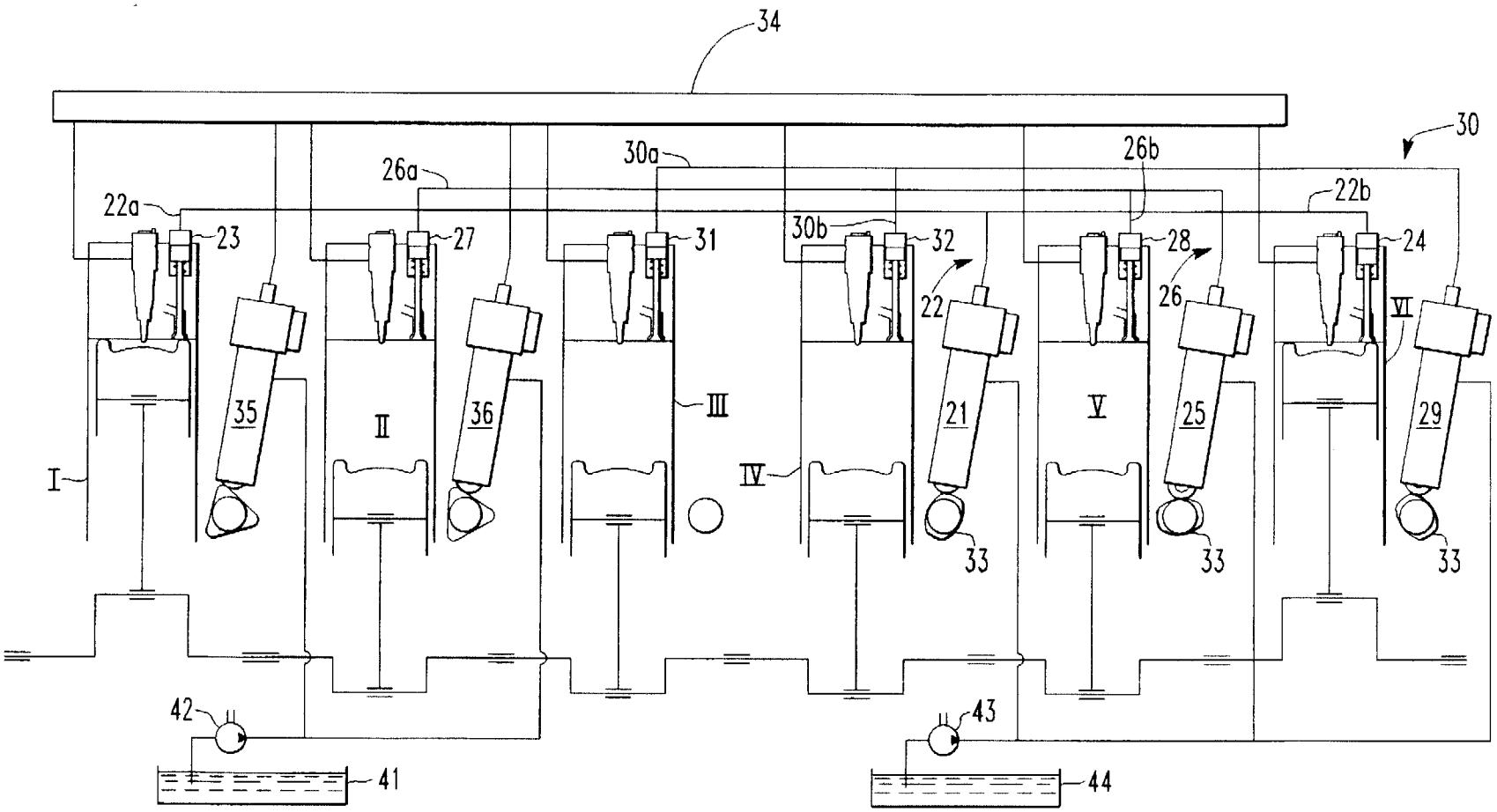
FIG. 2 shows the engine brake system on a six-cylinder internal combustion engine.

FIG. 2 shows the engine brake system for a six cylinder internal combustion engine in which a fuel container is designated by 41 and a feed pump by 42. The feed pump 42 supplies fuel to plug-in pumps 35, 36. 43 designates an oil pump which sucks oil out of an oil container 44 and feeds it to the plug-in pumps 21, 25 and 29.

Instead of oil, fuel from the common low pressure fuel system of the fuel injection system may be used for supplying the high pressure pumps with fluid for operating the decompression valves.

What is claimed is:

1. An engine brake for a multicylinder Diesel engine having a cylinder head with at least one exhaust or decompression valve for each cylinder for controlling the discharge of gases from said cylinder, a high pressure fuel injection system including a common fuel supply line for distributing fuel under pressure to the various cylinders and at least one cam shaft-operated plug-in high pressure fuel pump for supplying fuel under pressure to said common fuel supply line, and an engine brake actuating system including for every two cylinder operating at a 360° crankshaft phase difference a plug-in pump which, during engine braking operation concurrently operates the exhaust or decompression valves of the associated two cylinders, alternately one at the end of a compression stroke and the other at the end of an exhaust stroke, said plug-in pump being operated by a camshaft driven double-cam cam structure.

2. An engine brake according to claim 1, wherein two plug-in pumps are utilized for supplying fuel under pressure to said common fuel supply line.

3. An engine brake according to claim 1, wherein, in a four cylinder engine having cylinders I, II, III, and IV with an ignition sequence I, III, IV, II and two cylinders with a crankshaft phase displacement of 360°, one of said plug-in pumps which operate said exhaust or decompression valves is connected, by a common pressure line, to cylinders I and IV and the other is connected, by a common pressure line, to cylinders II and III.

4. An engine brake according to claim 1, wherein, in a six cylinder engine with an ignition sequence I, V, III, VI, II, IV and three sets of two cylinders with a crankshaft phase displacement of 360°, one of said plug-in pumps which operate said exhaust or compression valves is connected to the exhaust or decompression valves of the cylinders I and VI, another to the exhaust or decompression valves of the cylinders II and V and the third plug-in pump to the exhaust or decompression valves of the cylinders III and IV.

* * * * *